US005591105A

United States Patent [19]

Dalebout et al.

[11] Patent Number: 5,591,105

[45] Date of Patent: Jan. 7, 1997

[54] EXERCISE STEP BENCH WITH ADJUSTABLE LEGS

[75] Inventors: William T. Dalebout; Scott R. Watterson, both of Logan, Utah; Paul Furner, Racine, Wis.

[73] Assignee: ICON Health & Fitness, Inc., Logan, Utah

[21] Appl. No.: 360,565

[22] Filed: Dec. 21, 1994

[51] Int. Cl.[6] ..... A63B 5/00

[52] U.S. Cl. ..... 482/52; 482/51; 248/188.2; 248/911

[58] Field of Search ..... 108/12, 144, 112, 108/106; 297/423.45; 248/188.2, 188.5, 188.4; 242/919, 395, 379.2

[56] References Cited

U.S. PATENT DOCUMENTS

| | | | |
|---|---|---|---|
| D. 287,283 | 12/1986 | Johnson . | |
| 298,257 | 5/1884 | Vail | 248/188.5 |
| D. 299,501 | 1/1989 | Howze . | |
| D. 300,045 | 2/1989 | Grider . | |
| D. 322,826 | 9/1989 | Wilkinson | D21/191 |
| D. 323,537 | 1/1992 | Wilkinson . | |
| D. 327,718 | 7/1992 | Kofler . | |
| D. 330,057 | 10/1992 | Saunders et al. . | |
| D. 330,234 | 10/1992 | Saunders et al. . | |
| D. 332,647 | 1/1993 | Johnson . | |
| D. 333,329 | 2/1993 | Jacobs . | |
| D. 337,362 | 7/1993 | Goldstein et al. . | |
| D. 339,179 | 9/1993 | Wilkinson . | |
| D. 346,189 | 4/1994 | Chen . | |
| 3,164,351 | 1/1965 | Rembowski | 248/188.5 |
| 4,340,218 | 7/1982 | Wilkinson . | |
| 4,407,027 | 10/1983 | Colon, Jr. | 242/919 |
| 4,561,652 | 12/1985 | Wilkinson . | |
| 4,648,593 | 3/1987 | Wilkinson . | |
| 4,659,075 | 4/1987 | Wilkinson . | |
| 4,984,785 | 1/1991 | Wilkinson . | |
| 4,993,706 | 2/1991 | Wilkinson . | |
| 5,037,084 | 8/1991 | Flor . | |
| 5,050,861 | 9/1991 | Thomas et al. . | |
| 5,066,001 | 11/1991 | Wilkinson . | |
| 5,096,186 | 3/1992 | Wilkinson et al. . | |
| 5,108,089 | 4/1992 | Wilkinson . | |
| 5,116,044 | 5/1992 | Wilkinson et al. . | |
| 5,118,095 | 6/1992 | Flor . | |
| 5,118,096 | 6/1992 | Wilkinson et al. . | |
| 5,125,646 | 6/1992 | Wilkinson . | |
| 5,127,647 | 7/1992 | Wilkinson . | |
| 5,154,678 | 10/1992 | Adamczyk et al. . | |
| 5,162,028 | 11/1992 | Wilkinson . | |
| 5,169,360 | 12/1992 | Saunders . | |
| 5,176,596 | 1/1993 | Ullman . | |
| 5,213,554 | 5/1993 | Goldstein et al. . | |
| 5,248,286 | 9/1993 | Wilkinson et al. . | |
| 5,275,579 | 1/1994 | Wilkinson . | |
| 5,328,427 | 7/1994 | Sleamaker . | |
| 5,425,691 | 6/1995 | Van Der Hoeven . | |

*Primary Examiner*—Jerome Donnelly
*Attorney, Agent, or Firm*—Trask, Britt & Rossa

[57] ABSTRACT

A step bench for performing repetitive stairstep exercises has adjustable-height support members and a retractable floor mat. The adjustable-height support members are configured as telescoping cylinders, with vertically extending stair-like slots formed in the wall of one of the cylinders, and corresponding pegs attached to the adjacent wall of the other cylinder to extend slidably through the slots. The height of the support members is adjusted by rotating the cylinders relative to each other to move the pegs from one "stair" of the slot to an upper or lower "stair". A retractable floor mat assembly comprises a roller mounted beneath the bench platform to left and right flanges depending from the ends of the platform, with a mat wound about the roller in a manner similar to a windowshade.

23 Claims, 5 Drawing Sheets

EXERCISE STEP BENCH WITH ADJUSTABLE LEGS

BACKGROUND OF THE INVENTION

1. Field of the Invention

The invention relates to exercise equipment and particularly concerns benches for aerobic step exercising.

2. State of the Art

Low benches or step benches for use in performing repetitive stepping up and down exercises are known. Such bench devices are used in some exercise classes and are also available for use at home. The difficulty of the exercise and the degree of conditioning attained varies with, among other things, the height of the step, the frequency of exercise (e.g., number of times exercises are performed per week), the time or duration of the exercise and the rate or repetitions (i.e., steps per unit of time). Desirably, a bench for step exercises should be adjustable in step height. Adjustability allows a user to vary the difficulty of the exercise either during a particular session, or over a series of sessions. The height adjustment mechanism should be reliable and easy to operate. Also desirably, the bench should be lightweight and portable so that it is easily carried from home to class, or moved back and forth during a group class from a storage location to a central floor area, as needed, or easily transported and stored within the home. A step bench should, nevertheless, be of sturdy and durable construction, to withstand the repetitive stepping and weight of a human exerciser.

Numerous exercise step benches have been made, as exemplified by U.S. Pat. Nos. 5,275,579, 5,118,096, 5,116,044, 5,096,186, and 5,066,001 all to Wilkinson et al., 5,037,084 (Flor), 5,154,678 (Adamczyk), 5,176,596 (Ullman), 5,213,554 (Goldstein et al.), and 5,050,861 (Thomas et al.). Some of the described step benches require disassembly of the support members from the bench to adjust the height. Such an arrangement involves the risk of improper assembly or reassembly and the risk of loss of parts. Some step benches do not provide a sufficient range of height adjustment. Others do not provide as much stability as is desirable to the horizontal motion exerted as a user steps up and down repetitively. In still others, the height adjustment mechanism is not strong enough to withstand the hard use associated with aerobic step exercising.

From another perspective, step exercises are often performed in conjunction with floor-based exercises, including stretching exercises, sit-ups or leg raises, etc. Most individuals prefer to perform such floor exercises on a cushioning mat for comfort. However, it is cumbersome to transport both a mat and a step bench to class or to and from a storage area. Thus, it is desirable to have a combination bench and mat apparatus. The drawback of this device is that the stacked mat segments are relatively soft and compressible, making the stepping exercise more difficult and unpleasant for the user and hindering the pace of the stepping.

Accordingly, a need remains for an improved adjustable-height platform for repetitive stairstep exercising. Such a step bench should provide a firm surface for stepping upon and be sturdy, durable and easily portable. Further, a need remains for such a step bench having an integrally-associated exercise mat for floor exercises.

SUMMARY

A step bench for performing repetitive stairstep exercises includes adjustable-height support members and/or a retractable floor mat. The adjustable-height support members are configured as telescoping members, with vertically ascending staircase-like slots formed in the wall of one of the members, and corresponding pegs attached to the adjacent wall of the other member to extend slidably through the slots. The height of the support members is adjusted by rotating the members relative to each other to move the pegs from one "stair" of the slot to an upper or lower "stair". The "stairs" allow relative rotation of the two members, while the vertical slot segments which alternate with the "stairs" permit the members to be telescopingly extended or contracted. The members preferably are cylinders.

A retractable floor mat assembly comprises a roller mounted beneath the bench platform, with a mat wound about the roller in a manner similar to a windowshade.

BRIEF DESCRIPTION OF THE DRAWINGS

In the drawings, which illustrate what is presently regarded as the best mode of carrying out the invention.

DETAILED DESCRIPTION OF THE ILLUSTRATED EMBODIMENT

A preferred embodiment of a step bench 100 has a platform 102 for stepping upon and four generally cylindrical support members 104. Platform 102 optionally has a covering 106 adhered thereon to provide a degree of cushioning for stepping or sitting on during exercise. The covering 106 may also have a friction surface to reduce the possibility of slippage by the foot of a user.

The platform 102 presents a preferred flat top surface as depicted. However, other platform shapes may have portions that are not flat to direct the feet of a user or to accommodate other features or functions. Further, the platform 102 as shown is generally rectilinear in projection. However, other geometric shapes may be used (e.g. circular, oval) as desired. Other geometrical shapes may employ different numbers of support members 104. For example, a circular (in projection) platform may use three support members 104 spaced approximately 120° apart around the perimeter of the platform.

Figure 8:
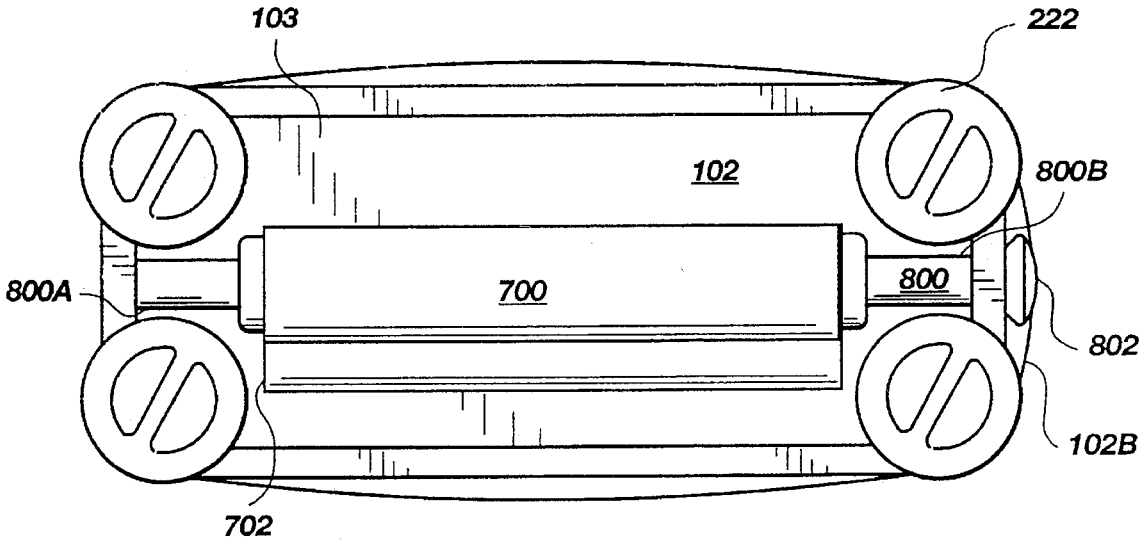
FIG. 8 is a bottom view of the bench of FIG. 7 with the mat in a retracted position.

Support members 104 are configured to provide for adjustment of the step bench to different or selected heights. As seen in the exploded view of FIG. 2A, an adjustable support member 104 has an upper cylindrical member 200 and a lower cylindrical member 202. Upper cylindrical member 200 is affixed at or proximate its upper edge 201 by conventional means such as gluing, welding, bolting or clamping to the underside 103 (FIG. 8) of the platform 102. Upper cylindrical member 200 has a hollow interior and a plurality of slots 206 extending through the wall 203. As here shown, three slots spaced approximately 120° apart are preferred. However, one slot may be sufficient, and other numbers of slots may be selected including two or four or more. Each slot 206 is configured as a series of vertical or upright segments 208 contiguously alternating with horizontal or transverse segments 211A, 211B or 211C. Each slot 206 begins with a vertical segment 208 at the upper end 207 of the member 200, and terminates in a horizontal segment 211C at the lower end 209. As here shown, the slot 206 has three horizontal segments 211A, 211B and 211C. Each horizontal segment 211A, 211B and 211C equates to a different height 105 of the platform 102 for selection by the user. The horizontal segments 211A, 211B and 211C may each have notch 211D formed as shown to facilitate retention of the related peg 220 as discussed hereinafter. It should be noted that the vertical segmentary do not need to be perfectly vertical but rather they may be off the vertical to be upright. Similarly, the horizontal members need not be horizontal but simply transverse to the vertical segments.

Figure 3A:
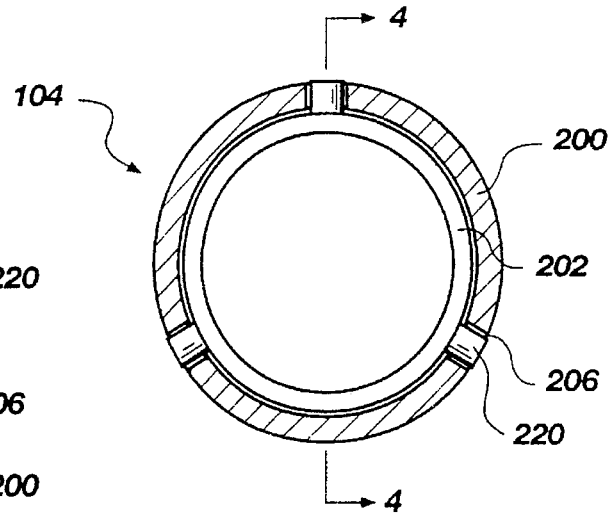
FIG. 3A is a top view in partial cross-section of the support member of FIG. 2.

Lower cylindrical member 202 has a plurality of pegs 220 extending outward from the outer surface 202A. Each peg 220 may be secured to the member 202 by, for example, a threaded connection to a threaded aperture by a force fit into an aperture, by welding or by other suitable means. The number of pegs 220 corresponds to the number of slots 206. In the assembled support member, the upper cylindrical member 200 is slidably and telescopically disposed over the lower cylindrical member 202, and pegs 220 register with respective slots 206 and are slidably engaged in the slots 206 (FIG. 3). Desirably, the lower cylindrical member 202 is formed with, attached to or seated in, a base 222 to provide extra stability for the step bench 100.

Figure 3B:
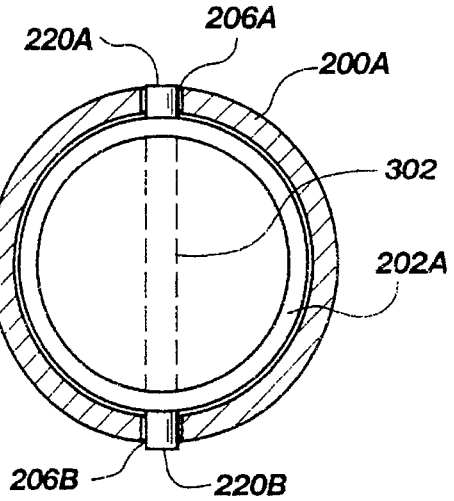
FIG. 3B is a top view in partial cross-section of an alternate embodiment of the support member.

The presently preferred embodiments have interconnecting adjustment means here shown to be three pegs 220 positioned to register with the slots 206. The pegs 220 are arranged at the same height 230 on the inner cylinder, and displaced from each other at angles of about 120° to register with respective slots 206. However, as noted hereinbefore, other arrangements are within contemplation. For example, as seen in FIG. 3B, there could be just two pegs 220A and 220B disposed opposite each other on the inner cylinder 202A, and correspondingly two slots 206A and 206B on the outer cylinder 200A. In such an embodiment, instead of having two separate pegs 206A and 206B, a single bar 302 may extend through both sides of the inner cylinder, for added strength as shown by dotted lines in FIG. 3B.

Figure 1:
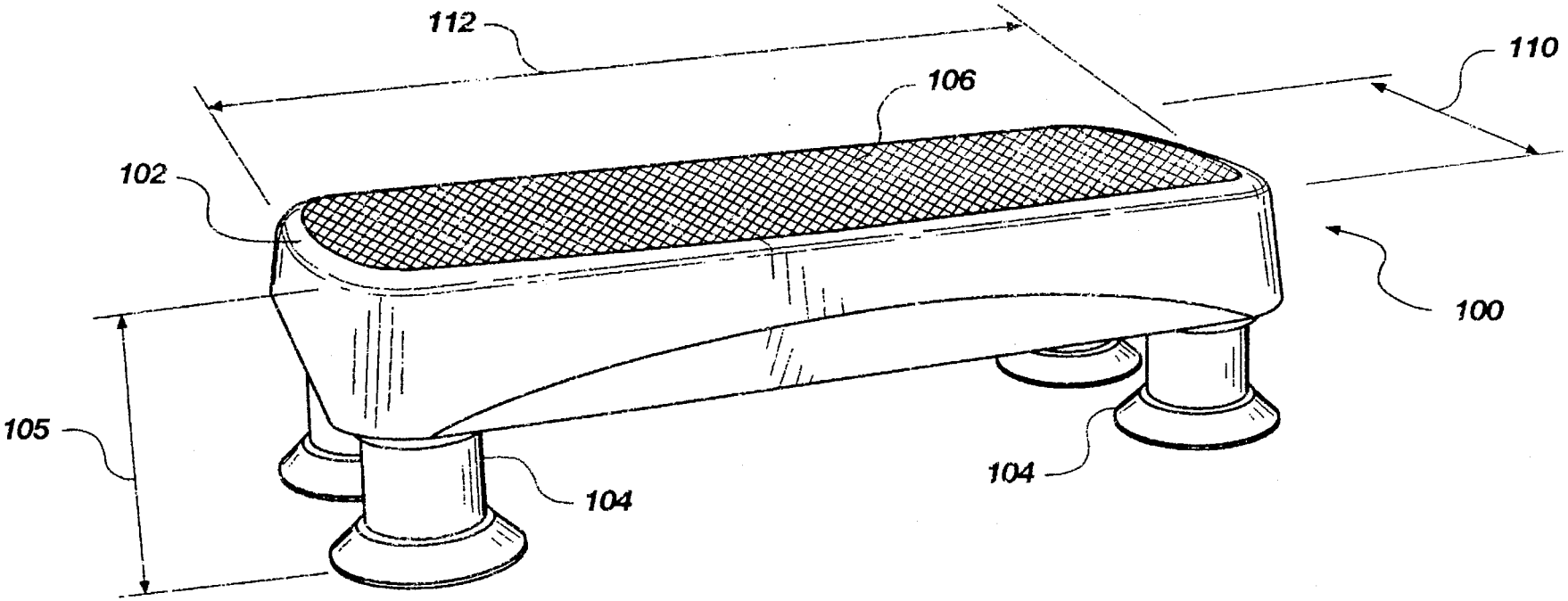
FIG. 1 is a perspective view of a step bench of the invention.

It should be noted that the support members 104 shown in FIG. 1 and the upper cylindrical member 200 and lower cylindrical member 202 are shown to be cylindrical in shape. However, other shapes and configurations may be used as desired so long as relative axial movement 232 and rotational movement 234 is provided. For example, the support members may be semi-cylindrical (half circles in cross section) or they may involve combinations of geometric shapes.

Figure 4:
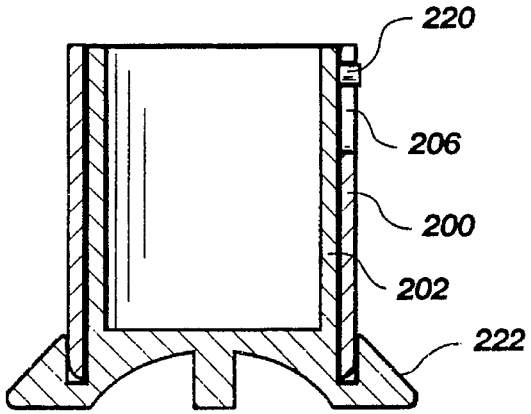
FIG. 4 is a cross-section view of the support member taken along line 4—4 of FIG. 3, with the support member of FIG. 2A in a lowered configuration.
Figure 5:
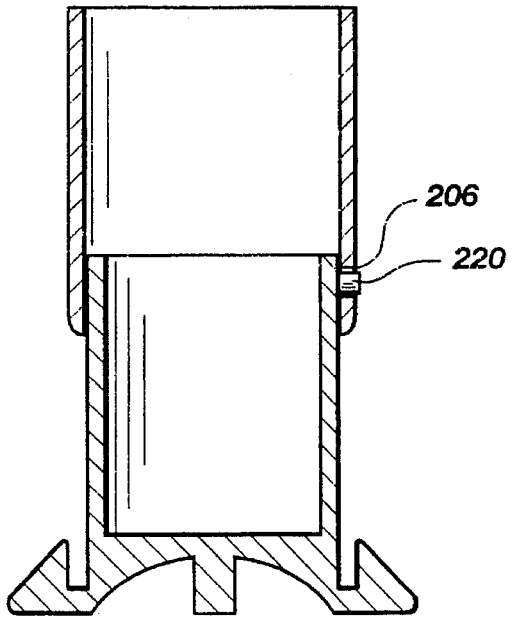
FIG. 5 is a cross-section view of the support member of FIG. 2A in an elevated configuration.
Figure 6:
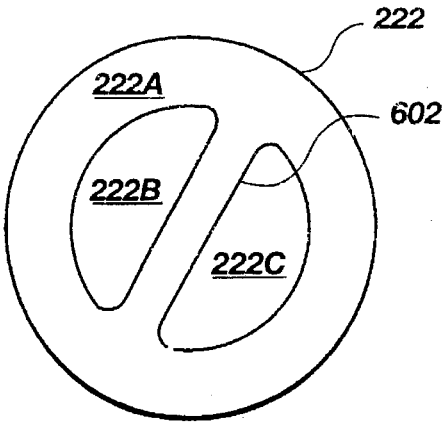
FIG. 6 is a bottom view of the support member.

FIGS. 4 and 5 respectively depict the support member in cross-section in its fully lowered and fully elevated positions. By rotation of the upper cylinder 200 and lower cylinder 202 relative to each other, the pegs 220 can be moved simultaneously through and along their corresponding slots 206 from one top vertical section 208 to each horizontal segment 211A, 211B and 211C to provide for four separate heights 105. Desirably a peg 220 will register with a corresponding notch such as notch 211D to more securely retain the support 104 at the desired height 105. That is, intermediate heights of the step bench 100 are achieved by positioning the pegs 220 on one of the three horizontal segments 211A, 211B and 211C or by positioning the peg 220. Desirably, the underside 222A at the top of the vertical section 208 of base 222 of the support member is configured with recessed portions 222B and 222C to form a handle or a gripping portion 602, as seen in FIG. 6. Other configurations of the base 222 may be used to facilitate grasping by the user for rotation of the lower cylinder 202 relative to the upper cylinder member 200.

Figures 2A, 2B, 2C, 2D:
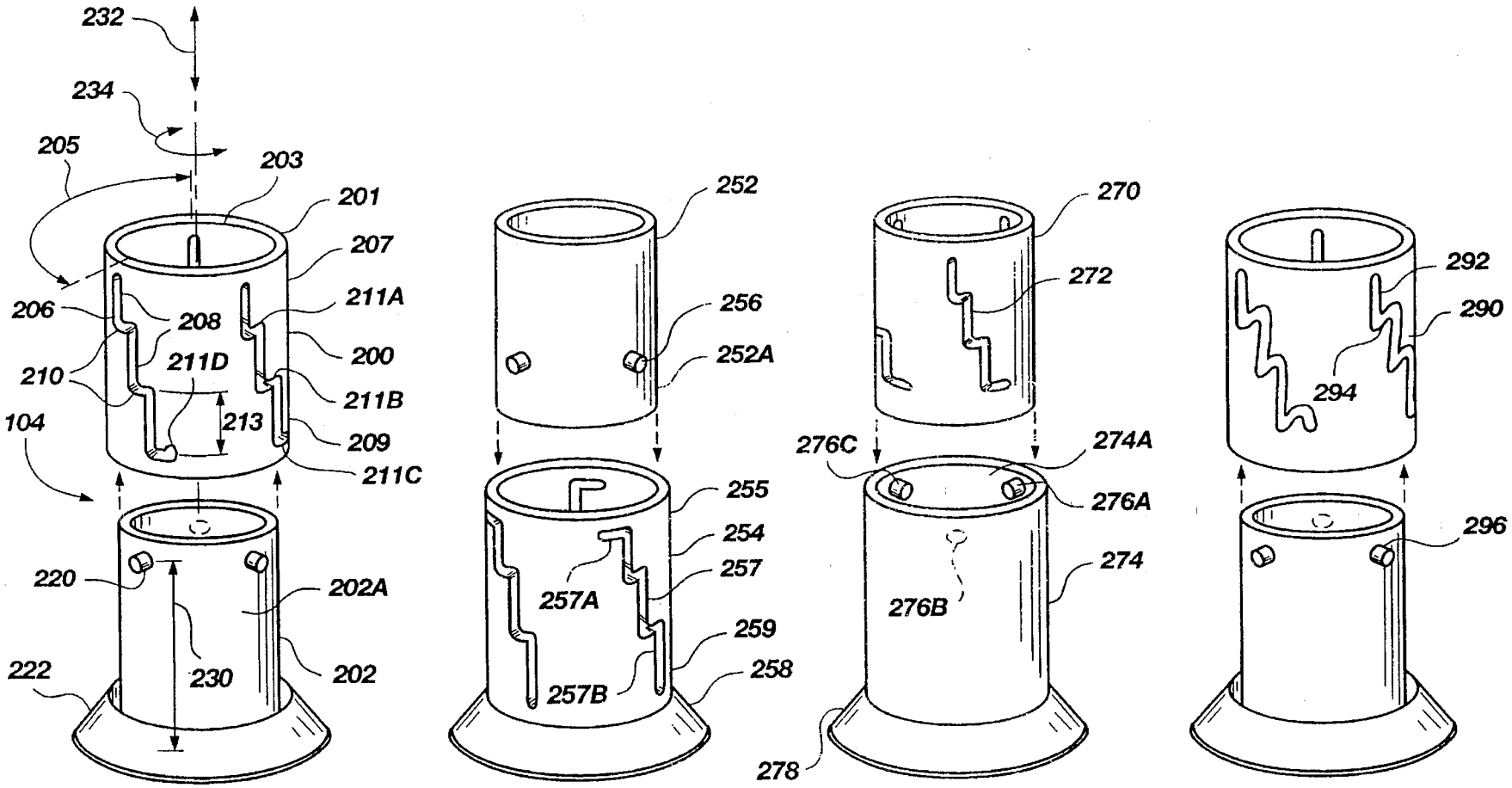
FIG. 2A is an exploded perspective view of a support member of the bench of FIG. 1.
FIG. 2B is an exploded perspective view of an alternate embodiment of a support member.
FIG. 2C is an exploded perspective view of a second alternate embodiment of a support member.
FIG. 2D is an exploded perspective view of a third alternate embodiment of a support member.

Alternate arrangements of slots and pegs are possible, as shown in FIGS. 2B, 2C and 2D. For example, the relative positions of the inner and outer cylinders may be reversed. In the embodiment of FIG. 2B, an inner cylinder 252 is affixed to the underside of the platform, with pegs 256 near its lower end 252A. Outer cylinder 254 is fixed to the base 258. Slots 257 in the outer cylinder 254 have a slightly different shape, having a horizontal segment 257A at the upper end 255 and a vertical segment 257B at the lower end 259.

In another alternate embodiment shown in FIG. 2C, an inner cylinder 270 is attached to the underside of the platform, and has slots 272 formed therein. Outer cylinder 274 is mounted to the base 278, and has pegs 276A, 276B and 276C on its inner surface 274A. Conversely, the positions of the inner and outer cylinders may be reversed, with an outer peg-carrying cylinder attached to the platform, and an inner slot-carrying cylinder mounted on the base (not shown).

Still another alternate embodiment (FIG. 2D) has slots 290 of a slightly different shape from the configuration shown in FIGS. 2A, 2B and 2C. In this embodiment, slots 290 have vertical segments 292 linked by curved segments 294 which curve upward. Providing upward curvature in a horizontally-translating segment of the slot inhibits the pegs 220 from slipping off one of the horizontal segments 210 into an adjacent descending one of vertical segments 208 (see FIG. 2A for comparison).

Figure 7:
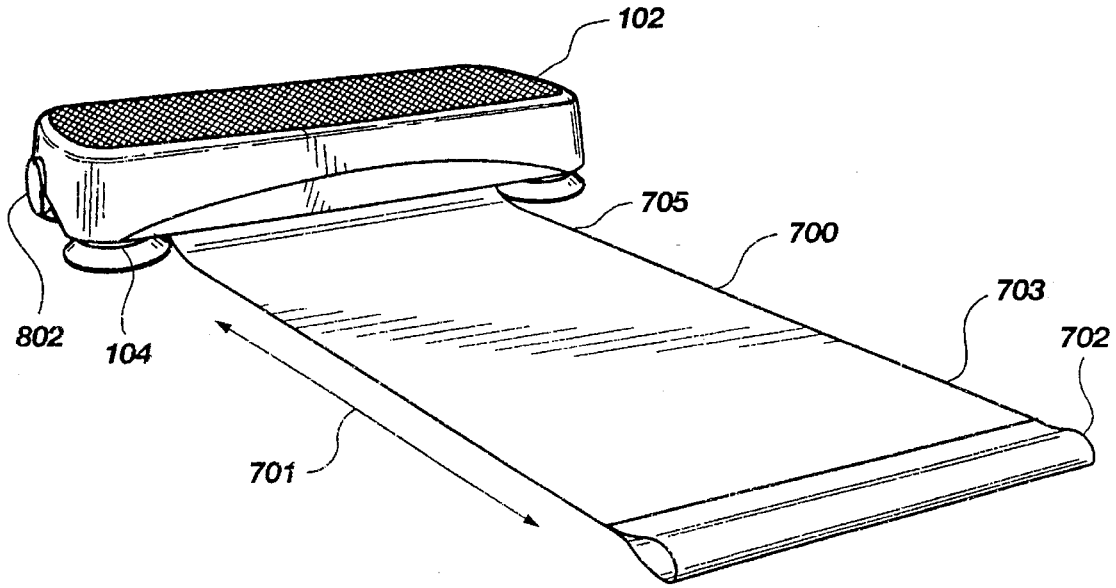
FIG. 7 is a perspective view of an alternate embodiment of a step bench having an integrally associated floor mat, with the mat in an extended position.

Turning to FIG. 7, a highly preferred embodiment of a step bench has adjustable-height support members 104 (shown in the lowest height configuration of FIG. 4), together with a self-contained retractable mat 700. As better seen in FIG. 8, a roller 800 is mounted beneath the platform 102 with the mat 700 wrapped around it in a manner similar to a windowshade. The mat 700 may extend a distance 701 so the user may stand thereon and perform sliding exercises. That is a skating motion may be practiced or performed by sliding one of the user's feet alternately toward the end 703 and toward the end 705.

The mat 700 desirably has a gripping portion 702 here shown to be configured similar to the lower end of a windowshade, for gripping by a user to unroll the mat from the roller 800. Further, a handle or knob 802 is attached to one end of the roller 800 and extends slightly outward from one end 102B of the platform 102. Knob 802 can be rotated by a user to rotate the roller 800 to re-wind the mat 700 thereon. Alternately, the roller 800 may be configured with a spring and interior ratchet similar to a common window shade.

Figure 10:
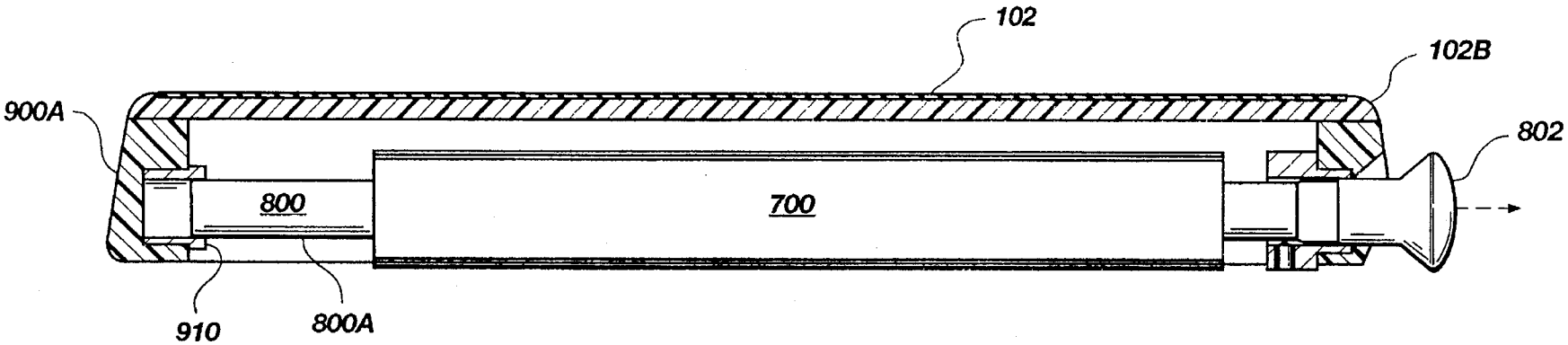
FIG. 10 is a cutaway view of the bench of FIG. 7 with a mat roller mechanism, showing the roller in an unlocked position.
Figure 9:
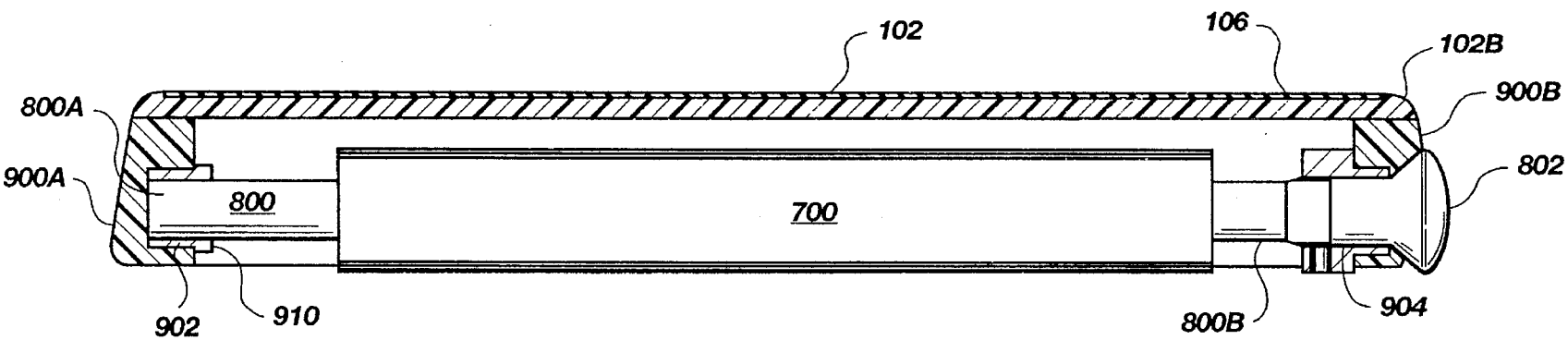
FIG. 9 is a cutaway view of the bench of FIG. 7 with a mat roller mechanism, showing the roller in a locked position.

In the illustrated embodiment, first side member 900A and second side member 900B depend respectively from the opposing ends of platform 102 (FIGS. 9 and 10). Roller 800 has one end 800A seated in a cylindrical notch 902 in first side member 900A. Knob 802 is mounted on the other end 800B of the roller 800; and the knob 802 extends through an opening 904 in the second side member 900B.

In a highly preferred embodiment, the roller 800 is mounted to the bench 100 with a locking mechanism to prevent accidental rotation of the roller and unwinding of the mat. As embodied here, the locking mechanism takes the form of a bushing 910 fixed within the cylindrical notch 902. In the locked position (FIG. 9), the end 800A of the roller 800 is seated all the way down in the bushing 910, which frictionally inhibits or entirely prevents rotation of the roller 800. By grasping knob 802 and pulling the knob 802 outward through the opening 904, the roller end 800A is moved out of the frictional seat of the bushing 910 (FIG. 10), thereby freeing the roller 800 to freely rotate for unwinding or rewinding of the mat 700.

It may be noted that the platform 102 of the step bench 100 may be made of any suitable string material. Various plastics and other synthetic compositions are preferred for ease of manufacture and to minimize weight. However, metals and woods may be used for selected applications if desired. Similarly, support members 104 may be made from a sturdy plastic or synthetic material. However, selected components may be made of appropriate metals as desired for selected applications.

The step bench 100 of FIG. 1 is shown to be generally rectilinear in projection having a width 110 and a length selected to provide a stable platform of sufficient area to facilitate ease in stepping. A width of about 18 inches and a length of about 30 inches may be used. However, the user may select other dimensions as desired.

The height 105 of the platform 102 may vary from about 6 inches to as much as 18 inches in particular embodiments. The increments or height of the vertical segments 208 may vary as desired. In the present embodiment, the height or length 213 of the segments 208 is about 2½ inches. Further, different segments 208 of a particular member 200 may be of different heights or lengths.

In use, the supports 104 will be selected to a desired height 105 by operating the gripping portion 602. The step bench 100 is then positioned on a support surface and may be used by stepping up onto and down from the platform 102 at a desired rate in the performance of exercises.

It will be apparent that other locking mechanisms known to those skilled in the art can be readily substituted for the friction bushing of the present embodiment. For example, various notching systems, detent systems and latch systems may be suitable for particular applications. Further, numerous other modifications to the specific structures shown in the drawings and described herein will be obvious to the ordinary artisan, and do not constitute a departure from the concept and execution of the invention. The claims alone define the scope of the invention.

What is claimed is:

1. A step bench for performing stair-step exercises, said step bench comprising:

a platform having a top surface for stepping on by a user and an underside surface;

a plurality of support members attached to said lower surface sufficient to stably support said step bench on a support surface, each of said plurality of support members having a pair of members moveable relative to each other axially and rotationally, said pair of members having means associated therewith to adjust their relative axial relationship and in turn the overall length of the respective support member;

a roller having first and second ends both disposed below and secured to said platform; and a mat having a fixed end attached to said roller, said mat being rotatably wrappable about said roller and said mat having a free end which may be gripped and pulled by a user to unroll the mat from said roller a preselected distance on a support surface.

2. The step bench of claim 1, wherein each said support member is formed of a first cylindrical member telescopingly associated with a second cylindrical member.

3. The step bench of claim 2, wherein:

said first cylindrical member has at least two substantially ascending slots formed therein, each of said slots comprising a plurality of generally upright segments alternating with transverse segments; and said second cylindrical surface has a plurality of pegs extending therefrom and corresponding in number to said slots, said pegs being snugly and slidably positioned in said slots.

4. The step bench of claim 3, wherein said platform is generally rectilinear in projection.

5. The step bench of claim 3, wherein said second cylindrical surface is an outer surface of an inner cylinder and said first cylindrical surface is an inner surface of an outer cylinder slidably disposed about said inner cylinder.

6. The step bench of claim 5, wherein said outer cylinder has an upper end which is attached to said underside of said platform, and said inner cylinder has a lower end for positioning on a support surface.

7. The step bench of claim 6, further including a base for positioning on a support surface at said lower end of said inner cylinder.

8. The step bench of claim 7, wherein said base has means for grasping by a user to rotate said inner cylinder relative to said outer cylinder.

9. The step bench of claim 6, wherein said inner cylinder has an upper end which is attached to said underside of said platform, and said outer cylinder has a lower end which rests on a floor.

10. The step bench of claim 3, wherein said first cylindrical surface is an outer surface of an inner cylinder and said second cylindrical surface is an inner surface of an outer cylinder slidably disposed about said inner cylinder.

11. The bench of claim 10, wherein said inner cylinder has an upper end which is attached to said underside of said platform, and said outer cylinder has a lower end which rests on a floor.

12. The step bench of claim 10, wherein said outer cylinder has an upper end which is attached to said underside of said platform, and said inner cylinder has a lower end for positioning on a support surface.

13. The step bench of claim 1, wherein said platform has two opposite ends and first and second flanges depending from said opposing ends; and wherein said roller is rotatably mounted at said first and second ends to said first and second flanges, respectively.

14. The step bench of claim 13, wherein said first end of said roller extends slidably through said first flange, and wherein a handle is adapted to said first end for operation by the user to rotate said roller for retracting or unrolling said mat.

15. An adjustable height bench for repetitive stepping upon by a user performing step exercises, said adjustable height bench comprising:

a platform having opposing ends, a top surface extending therebetween for stepping on by a user, and an underside surface;

at least one pair of support members attached to said lower surface at opposing ends of said platform, each of said support members comprising:

an inner cylindrical member having an outer surface and one or more protrusions extending outward from said outer surface, and an outer cylindrical member slidably annularly disposed about said inner cylindrical member, and having one or more slots each comprising at least one horizontal segment contiguous with a downwardly extending segment;

a roller rotatably mounted below said platform between said opposing ends; and a flexible mat having a fixed end attached to said roller, said flexible mat being wrapped around said roller, and said flexible mat having a free end which may be gripped and pulled by a user to unroll the mat from said roller.

16. The bench of claim 15, wherein said outer cylindrical member is attached to said underside surface and said inner cylindrical member has a lower end which contacts a support surface.

17. The bench of claim 16, wherein said lower end has means associated therewith for gripping by the user to rotate said inner cylindrical member within said outer cylindrical member.

18. The bench of claim 17, having two pairs of said support members respectively attached at the four corners of said platform.

19. The bench of claim 18, wherein said slots each comprise at least one rotational upper segment and one rotational lower segment connected by a first axial segment.

20. The bench of claim 15, wherein said roller has first and second ends, and further including a knob adapted to said first end for rotating said roller to retract or unroll said mat.

21. A combination step bench and floor mat for use in exercise sessions including repetitive stairstep exercises, consisting essentially of:

a single platform having opposing ends, a top surface extending therebetween for stepping on by a user, and an underside surface;

first and second flanges depending from said platform, said first flange disposed proximal to one of said opposing ends and said second flange disposed proximal to the other of said opposing ends;

support members attached to said lower surface at said opposing ends of said platform, said support members being operable to vary the height of said top surface above a support surface;

a roller having first and second ends, said roller being disposed below said platform and rotatably mounted at said first and second ends to said first and second flanges, respectively; and a flexible mat having a fixed end attached to said roller, said flexible mat being wrapped around said roller, and said flexible mat having a free end which may be gripped and pulled by a user to unroll the mat from said roller.

22. The bench of claim 21, wherein said first end of said roller extends slidably through said first flange, and further including a knob adapted to said first end for rotating said roller to retract or unroll said mat.

23. The bench of claim 22, wherein said second end of said roller is releasably mounted in a bushing, said bushing being attached to said second flange.

* * * * *